US006280597B1

(12) United States Patent
Kashiwada et al.

(10) Patent No.: US 6,280,597 B1
(45) Date of Patent: Aug. 28, 2001

(54) FLUORINATED METAL HAVING A FLUORINATED LAYER AND PROCESS FOR ITS PRODUCTION

(75) Inventors: Kunio Kashiwada; Takanori Kodama, both of Tokyo; Hiroyasu Taguchi; Satoshi Hirano, both of Kanagawa, all of (JP)

(73) Assignee: Showa Denko K.K., Tokyo (JP)

( * ) Notice: Subject to any disclaimer, the term of this patent is extended or adjusted under 35 U.S.C. 154(b) by 0 days.

(21) Appl. No.: 09/152,291

(22) Filed: Sep. 14, 1998

Related U.S. Application Data

(60) Provisional application No. 60/085,733, filed on May 15, 1998.

(30) Foreign Application Priority Data

Sep. 12, 1997 (JP) ..... 9-248231

(51) Int. Cl.[7] ..... C23C 8/34

(52) U.S. Cl. ..... 205/172; 148/269; 148/275; 148/281; 148/282; 148/283; 148/284; 148/285; 148/286; 205/171; 205/188; 205/190; 205/194; 205/199; 205/201; 428/469; 428/472.2

(58) Field of Search ..... 205/323, 316, 205/333, 171, 172, 188, 190, 194, 199, 201; 148/275, 276, 282, 283, 243, 269, 272, 281, 284, 285, 286; 428/469, 472.1, 472.2

(56) References Cited

U.S. PATENT DOCUMENTS

| | | | | |
|---|---|---|---|---|
| 2,993,819 | * | 7/1961 | Nessim | 148/6.27 |
| 4,111,762 | | 9/1978 | Wade et al. | 205/208 |
| 4,189,357 | * | 2/1980 | Riggs, Jr. | 205/205 |
| 4,484,954 | * | 11/1984 | Tarancon | 148/6.3 |
| 5,069,938 | * | 12/1991 | Lorimer et al. | 427/255 |

FOREIGN PATENT DOCUMENTS

| | | |
|---|---|---|
| 352061 | 1/1990 | (EP) . |
| 460700 | 11/1991 | (EP) . |
| 460701 | 11/1991 | (EP) . |
| 702098 | 3/1996 | (EP) . |

OTHER PUBLICATIONS

European Search Report Dated Oct. 12, 1998.
JP 04 202755, Patent Abstracts of Japan, vol. 016. No. 544, Jul. 23, 1992.
JP 06 073596 Patent Abstracts of Japan, vol. 018, No. 328, Mar. 15, 1994.

* cited by examiner

*Primary Examiner*—Kathryn Gorgos
*Assistant Examiner*—William T. Leader
(74) *Attorney, Agent, or Firm*—Sughrue, Mion, Zinn, Macpeak & Seas, PLLC

(57) ABSTRACT

The known flourinated layer has usually a thickness of from 1000 to 3000 angstroms. After the forced oxidation of metal, the forcibly oxidized surface is flourinated. As a result of the preceding forcing oxidation, a 1 $\mu$m or more thick fluorinated layer is formed on the surface of the metal.

61 Claims, 13 Drawing Sheets

MEASUREMENT RESULT OF OXIDE FILM BY GAS-PHASE OXIDATION

MEASUREMENT RESULT OF NATURAL OXIDE FILM ON Al ALLOY MATERIAL

MEASUREMENT RESULT OF OXIDE FILM FORMED BY GAS-PHASE OXIDATION

MEASUREMENT RESULT OF OXIDE FILM FORMED BY LIQUID-PHASE OXIDATION

FLUORINATED METAL HAVING A FLUORINATED LAYER AND PROCESS FOR ITS PRODUCTION

CROSS-REFERENCE TO RELATED APPLICATIONS

This application is an application filed under 35 U.S.C. §111(a) claiming pursuant to 35 U.S.C. §119(e)(1) of the filing date of the Provisional Application No. 60/085,733, filed May 15, 1998, pursuant to 35 U.S.C. §111(b).

BACKGROUND OF INVENTION

1. Field of Invention

The present invention relates to metallic material or film having a fluorinated surface layer, and a fluorination method of the metallic material or film. More particularly, the present invention provides fluorinated metal, on the top surface of which a thick fluoride layer greately enhances the corrosion resistance. The metal may be in any form capable of forming the fluoride layer thereon. The metal may be monolithic material or film formed on the substrate.

It is, particularly, intended by the inventive technology that the metallic material or film be used in a production apparatus of semiconductor devices and the like, so as to realize extremely advantageous corrosion performance against halogen-based corrosive gases, such as chlorine-, fluorine- or bromine-based gases.

2. Description of Related Art

In the production process of semiconductors, halogen-based, reactive and strongly corrosive special gases such as hydrogen chloride (HCl), boron trichloride ($BCl_3$), fluorine ($F_2$), nitrogen trifluoride ($NF_3$), chlorine trifluroride ($ClF_3$) and hydrogen bromide (HBr) are used. These gases are easily hydrolyzed by the presence of water in the environment, thus generating hydrochloric acid, hydrofluoric acid, hydrobromic acid and the like. The constructional metallic material or film of a valve, coupling, pipings, reaction chamber and the like for treating these gases is easily corroded and problems incurr.

In addition, these corrosive gases are converted to plasma or are thermally decomposed. They are decomposed to active atom species and are used for etching the oxide film or metallic film and are used for dry-cleaning the reaction chamber as well. Recently, in the production of super ULSIs and the production process of liquid crystals, the amount of such gases used has abruptly increased. The highest quality of cleanliness and corrosion performance is required for the plant materials, such as the surface of a reaction chamber.

In addition, since fluorine gas is mixed with inert gas (krypton, neon, argon) and is oscillated in the field of an excimer laser, extremely strict corrosion performance is required for the material surface of a plant against the fluorine radicals.

Electrolytically polished stainless steel SUS 316L can allegedly solve the above described problems and is usually used. Such stainless steel is subjected to baking at 250° C. prior to use. However, the corrosion resistance of stainless steel does not satisfactorily meet the requirements. Various nickel-based alloys have, therefore, been employed with halogen gas such as gaseous hydrechloric-acid at high temperature.

However, various problems are left unsolved in these parts as well.

First, the metallic material itself is expensive. The formability of the metallic material into parts of a plant is poor.

This finally leads to considerable cost increase of the plant. Furthermore, the corrosion resistance is attained only by a limited composition. For example, Hastelloy-C (Ni—Cr—Mo—W alloy) exhibits extremely improved corrosion resistance against the oxidizing acid and also exhibits improved corrosion resistance against even the reducing acid, such as hydrochloric acid, when used at room temperature. In addition, Hastelloy-C exhibits remarkable resistance against pitting corrosion and crevice corrosion. However, it is pointed out that, since the corrosion resistance of Hastelloy-C is poor against the fluorine gases and the fluorine radicals mentioned above, Hastelloy-C is not usable.

A large amount of research has heretofore been made with regard to the passivation technique with the use of fluorine gas. It is known that a passivation film in the order of angstroms is formed on the metallic surface of nickel so as to create the corrosion-resistance function.

In addition, Japanese Unexamined Patent Publication (kokai) No. 2-263972 is related to the invention entitled "Metallic Materials with Fluorinated Passivation Film Formed Thereon and Apparatus with the Use of Such Metallic Materials". The publication discloses the metallic material or film, on which the passivation film is formed, and an apparatus, in which the metallic material and coating are used. In this publication, a passivation film is formed by means of fluorine gas on the metal which is at least one selected from nickel, nickel alloy, aluminum, aluminum alloy, copper, copper alloy and chromium, among the metals. The corrosion resistance disclosed is of improved quality. However, the film formed is of from 1000 to 3000 angstrom thick and hence ultra thin. The surface state of aluminum, stainless steel, copper and nickel plates to be fluorinated in this publication is a polished surface.

In addition, Japanese Unexamined Patent Publication (kokai) No. 2-175855 is related metallic material or film, on which the fluorinated passivation film is formed, as well as an apparatus, in which the metallic material and film are used. The publication discloses a process for forming on the surface of stainless steel a mixed fluoride layer of iron fluoride and chromium fluoride. A fluorinated passivation film in the order of sub-micron thickness as well as the material with such film are disclosed. Improved corrosion resistance is disclosed. Thickness of the film formed is 4000 angstrom and is ultra thin. Incidentally, the polished SUS316L sheet is subjected to the fluorination.

Since the fluorinated passivation films formed in the above publications are of approximately 4000 angstroms or less in thickness, they are easily removed by flaws, friction and the like. It is, therefore, difficult to say that the films are appropriate as the material of production apparatuses of semiconductor devices from the viewpoints of durability and longevity.

The present invention aims to solve the problems involved in the prior art described above. The conventional passivation techniques are characterized in that the material surface is cleaned by polishing and the like and is then fluorinated to passivate it. It was discovered that, when the surface is oxidized to passivate it and is then fluorinated, surprisingly, not only the passivated and oxidized surface exhibits no hindrance to the fluorination, but also a rather thick fluorinated layer can be formed.

SUMMARY OF INVENTION

It is an object of the present invention to provide a fluorinated metal having a thick, stable and excellent durable fluoride layer.

It is also an object of the present invention to provide a fluorination method of metal, which can form a thick, stable and excellent durable fluoride layer.

In accordance with the present invention, there is provided a fluorinated metal having 1 μm or more thick fluorinated layer formed by forcibly oxidizing a surface of said metal and thereafter fluorinating the forcibly oxidized surface.

The present invention is, therefore, characterized in that the surface of the metallic material or film is forcibly oxidized and, thereafter, the fluorinated layer having 1 μm or more of film thickness is formed on said surface.

There is also provided a fluorination process of metal, comprising the steps of:

forcibly oxidizing a surface of the metal by oxidizing agent; and, bringing the forcibly oxidized surface into contact with the fluorination gas to form a 1 μm or more thick fluorinated layer.

The fluorination process according to the present invention is, therefore, characterized in that the metallic material or film is forcibly oxidized by oxidizing material, and, there-after the oxidized film is brought into contact with the fluorination gas.

The present invention is described hereinafter in detail.

DESCRIPTION OF EMBODIMENTS OF INVENTION

The metal, which is fluorinated in the present invention, may be any one which is reactive with fluorine and forms a stable fluoride. Particularly nickel, copper, silver and aluminum are preferable metal, since their corrosion resistance is greatly enhanced by fluorination. Iron is excluded in the present invention, because the iron fluoride formed is decomposed and dissociated due to the moisture in air. Corrosion is, therefore, promoted in an environment containing moisture (exposure to air). There is, thus, a danger of incurring a practical problem.

The metal may be an alloy containing nickel and the like.

In addition, the metallic film to be fluorinated according to the present invention can be the film of electrolytic plating, electroless plating, physical vapor deposition (PVD) and the like of nickel, silver or aluminum, or an alloy containing at least one of them.

As electrolytic plating, Ni plating, Ni—Cu plating, Ni—W plating and the like are mentioned. As electroless plating, Ni—P plating, Ni—B plating, Ni—P—W plating, Ni—P—B plating and the like are mentioned. In addition, as the PVD, the sputtering of Ni or its alloy is mentioned.

Various materials are mentioned as the substrate for forming a film. They are various metallic materials, such as stainless steel, aluminum-alloy, steels and the like, sintered metal, ceramics, engineering plastics. These materials are subjected to known surface preparation such as degreasing, pickling, polishing, and shot-blasting, prior to formation of the metallic film.

In the descriptions hereinbelow but before the examples, the metallic (alloy) material and the metallic (alloy) film is abbreviated as "metal". In the present invention, the metallic surface is first forcibly oxidized and subsequently the metallic oxide film is brought into reaction with fluorine. According to the natural oxidation, the thickness of the oxide film is from a few tens to a few hundreds angstroms at the highest. In addition, the metals, on which strong oxide can be formed in the case of natural oxidation, are limited to the specified metals, such aluminum. The term "natural oxidation" is defined in GLOSSARY OF TECHNICAL TERMS IN JAPANESE INDUSTRIAL STANDARDS, Fourth Edition (page 729) to mean the oxidizing reaction which occurs in air without artificial acceleration. The natural oxidation film is well known in aluminum materials (c.f., Fundamentals and Industrial Techniques of Aluminum Materials (in Japanese) publlished on May 1, 1985, page 186).

The forced oxidizing method is used in the present invention as described in detail hereinafter. When the fluorination is carried out after the forced oxidation, the substitution reaction of oxygen and fluorine takes place to form the fluorinated layer. The thickness of the fluorinated layer increases, therefore, in proportion to the thickness of the forced oxidizing layer and amounts to a few tens of μm. However, when the forced oxidizing layer becomes extremely thick, its adhesion to the substrate is lowered. Thickness of the layer seems to be limited to 10 μm. By controlling the thickness of the oxide film formed on the surface, the thickness of fluoride formed on the metallic surface can be made thicker than that obtained by the so-called passivation. Aluminum alloys, copper, nickel or its alloy have affinity to oxygen, and, hence, a natural oxide film is readily formed on the surface in the atmosphere. This natural oxide film has an extremely dense structure and is chemically stable as well.

Oxygen diffusion into the metal interior is, therefore, impeded at normal temperature, due to the presence of the oxide film. Even in the case of exposure to the atmosphere for a long period of time, the natural oxide film retains ultra thin thickness amounting to only a few tens to hundreds angstroms. It is, therefore, necessary to thicken the oxide film by means of the so-called forced oxidation. In the present invention, a workpiece having a natural-oxide film is not directly fluorinated but is forcibly oxidized and then fluorinated. The thickness of the forcibly oxidized layer is greater than that of the natural oxide film and is preferably approximately 1000 angstroms or more.

The wear resistance, corrosion resistance and durability of the so-formed fluoride layer, are improved to such a level that it is satisfactorily usable in a practicable way.

The fluoride layer is, broadly speaking, a layer which contains fluorine and preferably consists essentially of fluoride. The fluorination herein has a substantial meaning. That is, it is not necessary for 100% of the metallic to be replaced with fluoride. However, the oxygen is preferably replaced with fluorine to a level lower than the detection level of oxygen. The metal need not be necessarily uniformly fluorinated. Rather, the fluorinated layer may be of non-uniform thickness, and the fluoride region and fluorine diffusion region may be mixed.

When the fluorination is carried out after forced oxidation, not only is the oxidized layer merely replaced with fluorine to form the fluoride, but also fluorine diffuses into the metal bulk, with the result that a thick fluorinated layer can be formed. In this case, the fluorinated layer consists of the first layer essentially consisting of metallic fluoride and a second layer, underlying the first layer, and into which fluorine has been diffused.

The so-called gas-phase oxidation is a means to enable the forced oxidation. In this case, oxygen or its gas mixture with neutral or inert gas, is preferable. In addition, nitrous oxide, nitrogen peroxide, ozone, or their mixture with neutral or inert gas are also preferable. In such cases, the gases are brought into contact with the metal at high temperature.

Liquid-phase oxidation can be mentioned as another means for the forced oxidation. This can be carried out by means of immersion into a solution, such as nitric acid and hydrogen-peroxide water.

Furthermore, the metallic material may be anodically oxidized using an electrolyte, such as alkali, to form an oxide film on the surface thereof. In this case, oxygen formed on the anode is a means for the forced oxidation.

It is broadly known in the case of aluminnum alloys that an oxide film amounting to a few microns to a few tens of microns can be formed on the surface of aluminum alloys by the so-called alumite treatment (anodic oxidation treatment). It has been put into practical application, and, therefore can be employed.

As is described hereinabove, methods of forced oxidation can be combined depending upon such conditions as the thickness of the oxidation film and the kind of metal.

The gases capable of use for the fluorination are 100% gases such fluorine, chlorine trifluoride and nitrogen trifluoride, their diluted gases by inert gases such as nitrogen, helium, argon and the like, or plasma gases of fluorine or the like. The fluorination is a production method of a fluorine diffusion layer and a film of fluoride by means of bringing the gases into reaction with the oxidized film formed on the top surface-layer of the metal.

Specifically, the following implementation is possible. That is, the metal as described above is loaded in a normal-pressure gas-phase flowing-type reaction furnace. While the oxidizing gas is flowing, the reaction furnace is heated to a predetermined temperature and is held for a predetermined time. The furnace is then filled with fluorination gas at a predetermined temperature. The reaction is carried out for a predetermined time to fluorinate the surface. In this case, prior to loading the metal into a reaction furnace, the metal is degreased or demoisturized as usual, and the forced oxidation is subsequently formed. The purity of the subsequently formed, forcibly oxidized layer is therefore enhanced and defects are not formed in the layer. Since a thin natural oxide film of a few tens of angstroms, remaining on the metallic surface is forcibly oxidized together with the bulk, the thin natural oxide film need not be removed prior to the forced oxidation.

In addition, the temperature of a reaction furnace for forcibly oxidizing nickel and copper is usually from 200° C. to 600° C., in particular, preferably from 300° C. to 500° C.

Reaction time is usually from 1 hour to 48 hours, in particular, preferably from 3 to 24 hours. Aluminum is preferably anodically oxidized.

The fluorination temperature is usually from 100° C. to 700° C., in particular, preferably from 150° C. to 500° C. under the normal pressure. In addition, the reaction time is usually from 1 to 48 hours, particularly preferably from 3 hour to 24 hours. At lower than preferable temperature and time, the oxygen of the forcibly oxidized layer is not satisfactorily replaced with fluorine, and, furthermore, diffusion of fluorine from the top surface is not satisfactory. On the other hand, when the upper limits of temperature and time are exceeded, the reaction of fluorine is so abrupt that cracks generate in the film formed.

The present invention is explained in more detail with reference to the examples, in which the electrolytic Ni plating film and the electroless Ni plating film are fluorinated. The present invention is, however, not limited at all by the examples described below.

EXAMPLES OF SURFACE PREPARATION

Production Example 1

(Electrolytic Nickel Plating Film)

Figure 1:
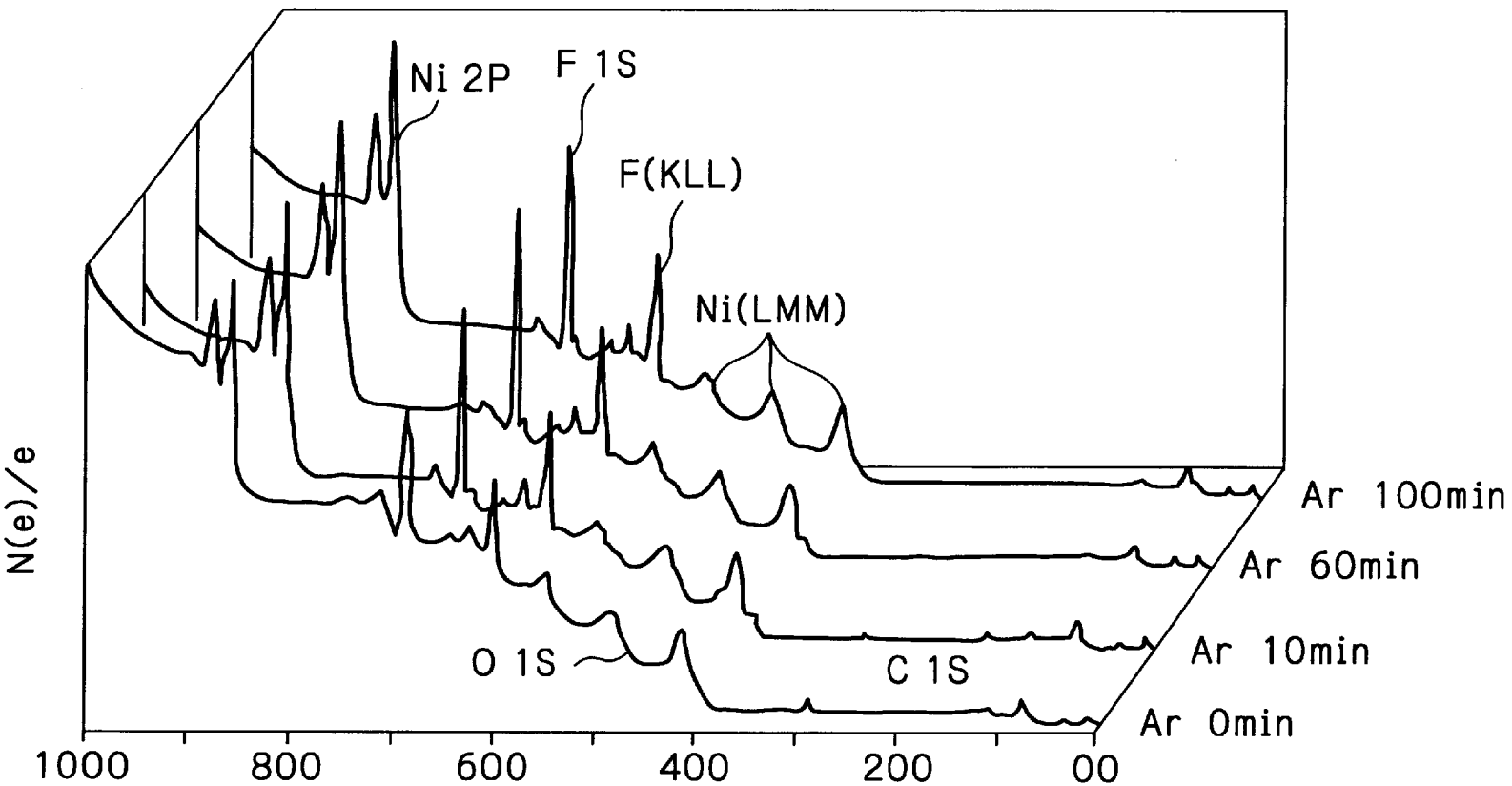
FIG. 1: chart showing the measurement results of XPS spectra of Example 4.

The plating was carried out by using commercially available lustrous nickel plating reagents of the so-called Watt bath, mainly composed of $NiSO_4$ (nickel sulfate), $NiCl_2$ (nickel chloride), $H_3BO_3$ (boric acid), and brightener. Stainless steel (SUS 316L) was preliminarily subjected to surface preparation by pickling. Film was then formed by conducting a current for a predetermined time at $1A/dm^2$ of current density.

Production Example 2

(Electroless Nickel Plating Film)

The acidic chemical nickel plating, which is referred to as the so-called chemical plating, has been put into practice. The reagents which are based on reduction with hypophosphorous acid are commercially available. The reagents used in the present production example were a commercially available reagent of chemical nickel plating, with the use of dimethylamine borane as the reducing agent, and a commercially available reagent of the chemical nickel plating, in which importance is attached to the corrosion resistance, that is, the nickel-phosphorus plating (Ni-P alloy plating).

These reagents consist of 25 g/L of $NiSO_4$ (nickel sulfate) as the main component, 20 g/L of $NaHPO_2$ (sodium hypophosphite) as the reducing agent, a complexing agent, stabilizing agent and brightener.

As in Production Example 1, the stainless steel sheets were preliminarily subjected to surface preparation, then immersed in a plating liquor solution, which has been elevated to a temperature of 90° C., so as to cause a reaction for a predetermined time and hence to form a film.

Production Example 3

(Electroless Nickel-alloy Plating Film)

The reagent used was commercially available alkaline chemical plating, in which importance is attached to the wear resistance and the post-heat treatment corrosion resistance, and which is carried out in a nickel-phosphorous-tungsten (Ni—P—W) bath. This reagent consists of 15 g/L of $NiSO_4$ (nickel sulfate) and $Na_2WO_3$ (sodium tungstate), i.e., the metallic component, 20 g/L of $NaHPO_2$ (sodium hypophosphite) as the reducing agent, complexing agent, a stabilizing agent, and brightener.

The stainless steel sheets were preliminarily subjected to a predetermined surface conditioning, as in the above-described examples, and then immersed in a plating liquor tank, which has been elevated to a temperature of 85° C., so as to cause a reaction for a predetermined time and hence to form a film.

Production Example 4

A5083 was taken as an example of the so-called aluminum alloy, and its surface was mirror-polished. A5083 was then exposed for 30 days in air, so as to thoroughly form a natural oxide film on the surface. Thus, specimens were provided.

Production Example 5

The so-called C1100P copper material was taken as an example of a Cu-alloy, and its surface was mirror-polished. C1100P was then exposed for 30 days in air so as to form thoroughly a natural oxide film on the surface. Thus, specimens were provided.

EXAMPLE 1

Specimens, which were prepared by the procedure described in Production Example 1, were loaded in the interior of a normal-pressure, gas-phase flowing-type reaction furnace. The specimens were pretreated by baking for 1 hour at 200° C. under reduced pressure to expel the adsorbed moisture and the like. The temperature was then elevated to 500° C. while introducing the oxygen gas (99.999%). The temperature was then held at that temperature for 12 hours so as to forcibly oxidize the metallic surface. Subsequently, the temperature was lowered while replacing the oxygen gas with nitrogen gas. When the temperature was lowered to 400° C., 20% $F_2$ gas (diluted with nitrogen) was introduced to replace the nitrogen. After the complete replacement, the surface fluorination was carried out by holding for 24 hours. After a predetermined time, the fluorine gas was replaced with nitrogen gas. After keeping the temperature at this level for 1 hour, the temperature was lowered.

EXAMPLE 2

Specimens, which were prepared by the procedure described in Production Example 1, were loaded in the interior of a normal-pressure, gas-phase flowing-type reaction furnace. The specimens were pretreated by baking for 1 hour at 200° C. under reduced pressure. The temperature was then elevated to 500° C. while introducing the oxygen gas (99.999%). The temperature was then held at that temperature for 12 hours so as to forcibly oxidize the metallic surface. Subsequently, the gas-replacement with nitrogen was carried out. At the temperature of replacement, the 20% $F_2$ gas (diluted with nitrogen) was introduced to replace the nitrogen gas. After the complete replacement, the surface fluorination was carried out by maintainig the conditions for 12 hours. After the predetermined time, the fluorine gas was replaced with nitrogen gas. After keeping the temperature at this level for 1 hour, the temperature was lowered.

EXAMPLE 3

Specimens, which were prepared by the procedure described in Production Example 2, were loaded in the interior of a normal-pressure, gas-phase flowing-type reaction furnace. The specimens were pretreated by baking for 1 hour at 200° C. under reduced pressure. The temperature was then elevated to 500° C. while introducing the oxygen gas (99.999%). The temperature was then maintained at 500° C. for 12 hours so as to forcibly oxidize the metallic surface. Subsequently, the gas-replacement with nitrogen was carried out, while lowering the temperature. When the temperature was lowered to 300° C., the 20% $F_2$ gas (diluted with nitrogen) was introduced to replace the nitrogen gas. After the complete replacement, the surface fluorination was carried out by holding the conditions for 12 hours. After a predetermined time, the fluorine gas was replaced with nitrogen gas. After keeping the temperature at this level for 1 hour, the temperature was lowered.

EXAMPLE 4

Specimens, which were prepared by the procedure described in Production Example 2, were loaded in the interior of a normal-pressure, gas-phase flowing-type reaction furnace. The specimens were pretreated by baking for 1 hour at 200° C. under reduced pressure. The temperature was then elevated to 500° C. while introducing the oxygen gas (99.999%). The temperature was then held at 500° C. for 12 hours so as to forcibly oxidize the metallic surface. Subsequently, the gas-replacement with nitrogen was carried out. At the temperature of replacement, the 20% $F_2$ gas (diluted with nitrogen) was introduced to replace the nitrogen gas. After the complete replacement, the surface fluorination was carried out by holding for 12 hours. After the predetermined time, the fluorine gas was replaced with nitrogen gas. After keeping the temperature at this level for 1 hour, the temperature was lowered.

EXAMPLE 5

Specimens which were prepared by the procedure described in Production Example 3, were loaded in the interior of a normal-pressure, gas-phase flowing-type reaction furnace. The specimens were pretreated by baking for 1 hour at 200° C. under reduced pressure. The temperature was then elevated to 500° C. while introducing the oxygen gas (99.999%). The temperature was then held at that temperature for 12 hours so as to forcibly oxidize the metallic surface. Subsequently, while the oxygen gas was being replaced with nitrogen gas, the temperature was lowered. When the temperature was lowered to 300° C., the 20% $F_2$ gas (diluted with nitrogen) was introduced to replace the nitrogen gas. After the complete replacement, the surface fluorination was carried out by holding at 300° C. for 12 hours. After a predetermined time, the fluorine gas was replaced with the nitrogen gas. After keeping the temperature at this level for 1 hour, the temperature was lowered.

EXAMPLE 6

Specimens which were prepared by the procedure described in Production Example 3, were loaded in the interior of a normal-pressure, gas-phase flowing-type reaction furnace. The specimens were pretreated by baking for 1 hour at 200° C. under reduced pressure. The temperature was then elevated to 500° C. while introducing the oxygen gas (99.999%). The temperature was then held at that temperature for 12 hours so as to forcedly oxidize the metallic surface. Subsequently, the gas replacement with nitrogen gas was carried out. At the temperature of replacement, the 20% $F_2$ gas (diluted with nitrogen) was introduced for replacement of nitrogen. After the complete replacement, the surface fluorination was carried out by holding the same temperature for 12 hours. After a predetermined time, the fluorine gas was replaced with the nitrogen gas. After keeping the temperature at this level for 1 hour, the temperature was lowered.

EXAMPLE 7

Surface mirror-polishing was carried out with regard to A5083, which was an example of the so-called aluminum alloy. The surface mirror-polished specimens were loaded into the interior of the normal-pressure gas-phase flowing-type reaction furnace. Baking pretreatment was carried out at 200° C. for 1 hour under reduced pressure. Temperature was then elevated up to 500° C. while introducing oxygen gas (99.999%). The metallic surface was forcibly oxidized by holding the temperature for 8 hours, followed by replacement with the nitrogen gas and then lowering the temperature. Specimens were thus provided.

EXAMPLE 8

Surface mirror-polishing was carried out with regard to C1100, which was an example of the so-called copper alloy. The surface mirror-polished specimens were loaded into the interior of the normal-pressure gas-phase flowing-type reaction furnace. Baking pretreatment was carried out at 200° C. for 1 hour under reduced pressure. Temperature was then elevated up to 500° C. while introducing oxygen gas (99.999%). The metallic surface was forcibly oxidized by holding the temperature for 8 hours, followed by replacement with the nitrogen gas and then lowering the temperature. Specimens were thus provided.

EXAMPLE 9

The specimen prepared by the procedure of Production Example 2 was immersed for 10 minutes in a 5% nitric-acid aqueous solution, the temperature of which had been elevated to 50° C. The specimen was further thoroughly washed with pure water and then left as it was, in the pure water for 8 hours to oxidize the surface. This specimen was loaded in a normal-pressure gas-phase flowing-type reaction furnace. The nitrogen gas was introduced into the furnace to replace the oxygen gas. After the replacement, the baking pretreatment was carried out at 200° C. for 1 hour under reduced pressure. Immediately after baking, the temperature was lowered.

Comparative Example 1

The specimen, which was prepared by the procedure of Production Example 3, was loaded into a normal-pressure gasphase flowing-type reaction-furnace. Baking pretreatment was carried out at 200° C. for 1 hour. Temperature was then elevated. When the furnace temperature reached 400° C., 20% $F_2$ gas (diluted with nitrogen) was introduced, followed by maintaining that state for 6 hours, hence carring out the fluorination of the metallic material. This is broadly known as the passiavation method of nickel materials. After that, nitrogen gas was introduced to replace the fluorine gas. After keeping the temperature at this level for 1 hour, the temperature was lowered.

Measurement Results of Film Thickness

Analysis results of the specimen of Example 4 by XPS (X-ray Photoelectron Spectroscopy) are shown in FIG. 1. Four elements were detected on the surface, i.e., Ni, F, O and C. Since the peaks of Ni greatly shift to the higher energy side than those of oxide, the bonding of Ni with F, which is an electrondonor couple, is predicted. In addition, both elements C and O were removed by argon-ion sputtering for a few minutes and could not then be detected. It is confirmed from this fact that both C and O elements result from moisture and contaminants adsorbed on the surface. Also, when the etching was carried out by argon-ion sputtering for as long as 100 minutes, no change in the detection pattern occurred. Film thickness of the fluorinated layer was deemed as the thickness where the fluorine atoms could be detected by the above-mentioned argon sputtering. However, a similar measurement was preliminarily carried out with regard to the oxygen-detection thickness of $SiO_2$ thin film, the thickness of which was already known. The sputter rate measured was 115 angstroms per minute (hereinafter referred to as "$SiO_2$ correction"). As a result, it turned out that the thickness of the fluorinated layer amounted to 1.2 $\mu$m or more.

X-ray diffractometrical analysis by a thin-film method was carried out with regard to the specimens of Production Examples 1, 2, 3 and Examples 2, 4, 6. The results are shown to as "$SiO_2$ correction". As a result, it turned out that the thickness of the fluorinated layer amounted to 1.2 $\mu$m or more.

X-ray diffractometrical analysis by a thin-film method was carried out with regard to the specimens of Production Examples 1, 2, 3 and Examples 2, 4, 6. The results are shown in FIGS. 2, 3, 4, 5, 6 and 7.

Figure 2:
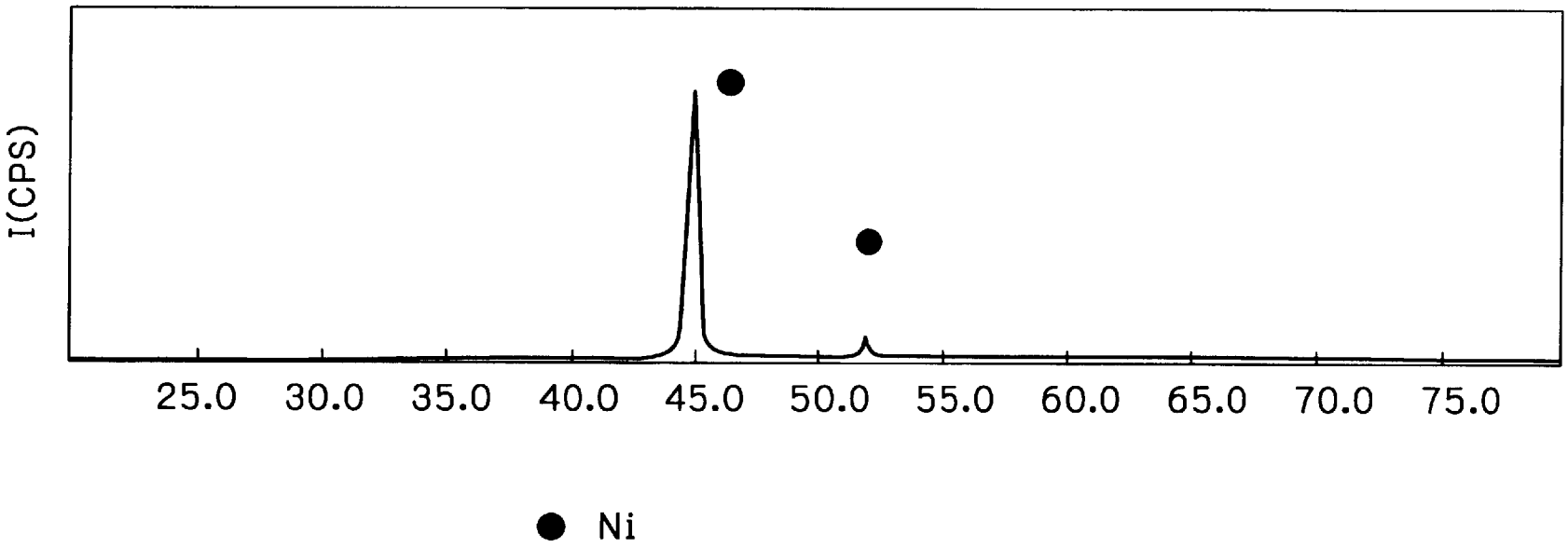
FIG. 2: chart showing the analytical results of Production Example 1 by the XDF thin-film method.

In FIG. 2, only the peaks of metallic Ni are detected.

Figure 3:
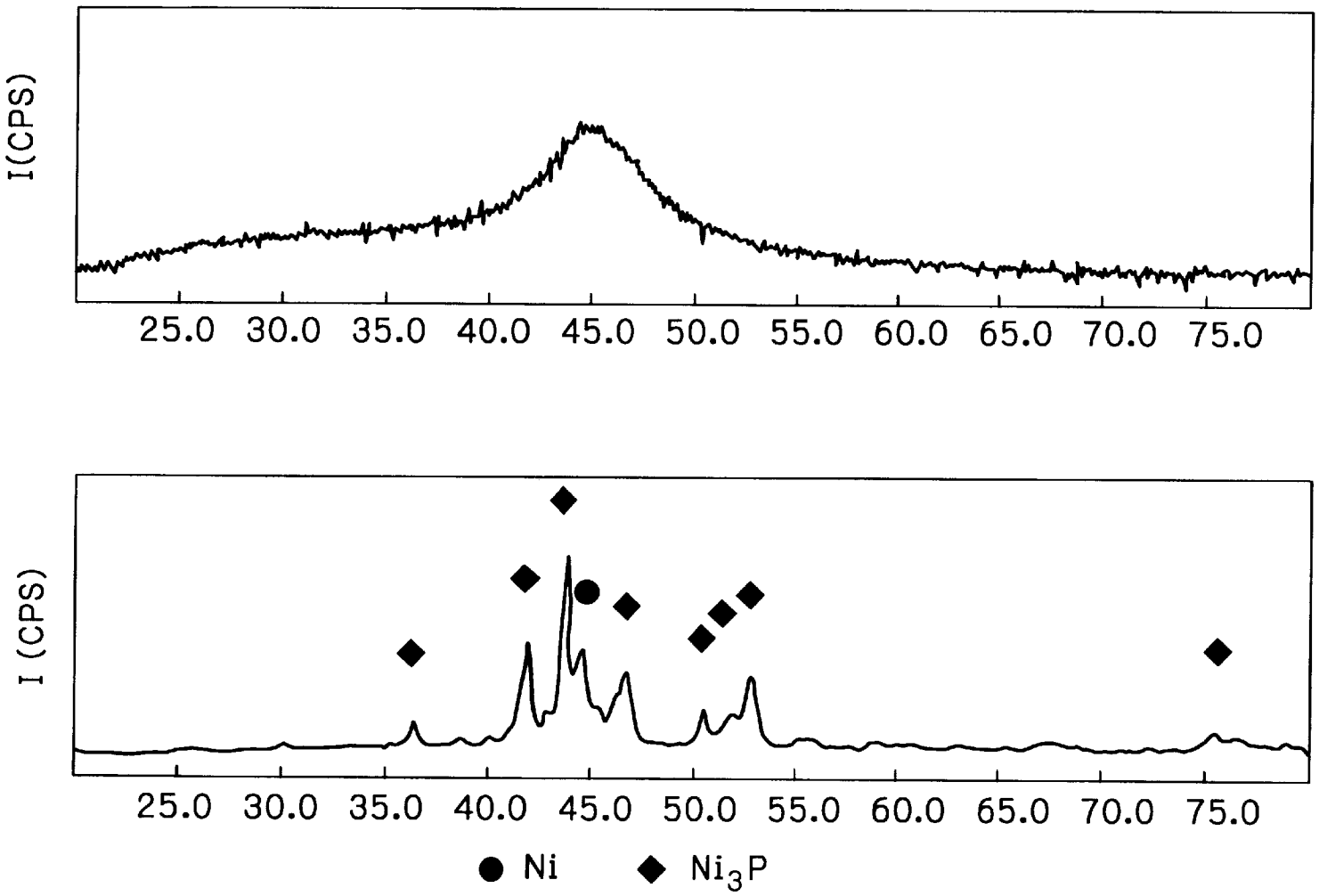
FIG. 3: chart showing the analytical results of Production Example 2 by the XDF thin-film method.
Figure 4:
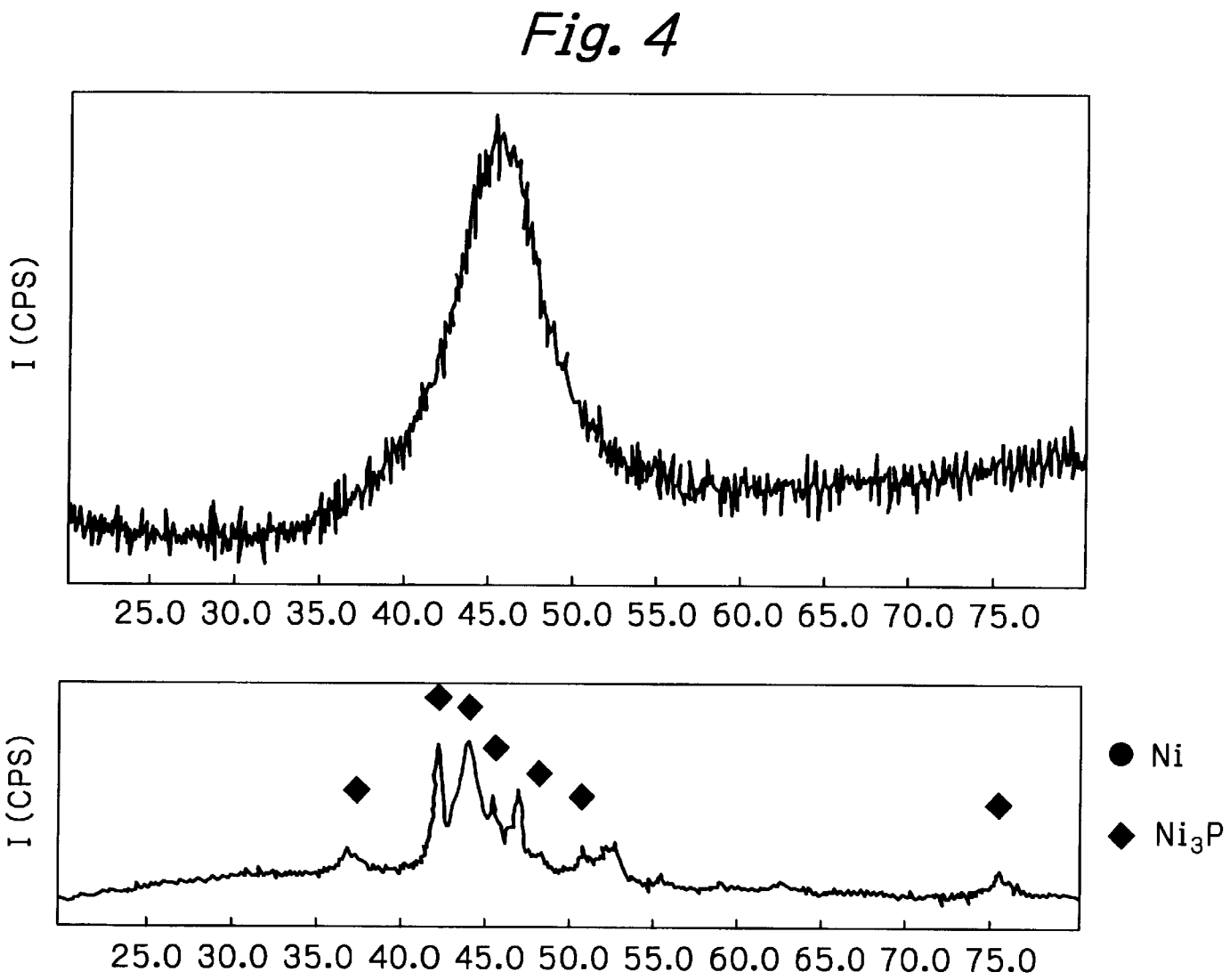
FIG. 4: chart showing the analytical results of Production Example 3 by the XDF thin-film method.

In FIGS. 3 and 4, broad peaks of Ni—P and Ni—P—W, from which the amorphous state can be confirmed, are obtained. When the heat treatment was additionally carried out at 400° C. for 3 hours under the nitrogen-gas atmosphere, it was confirmed that crystallized Ni and $Ni_3P$ had been formed.

Figure 5:
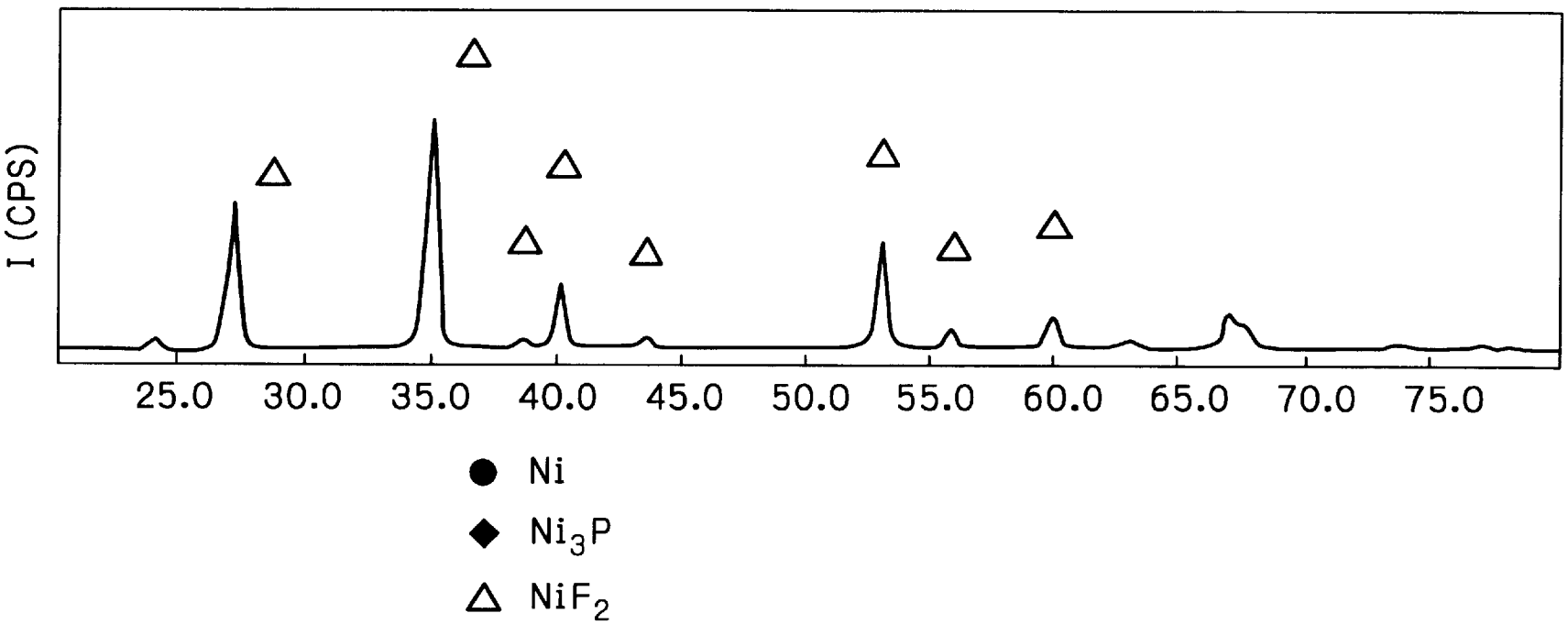
FIG. 5: chart showing the analytical results of Example 2 by the XDF thin-film method.
Figure 6:
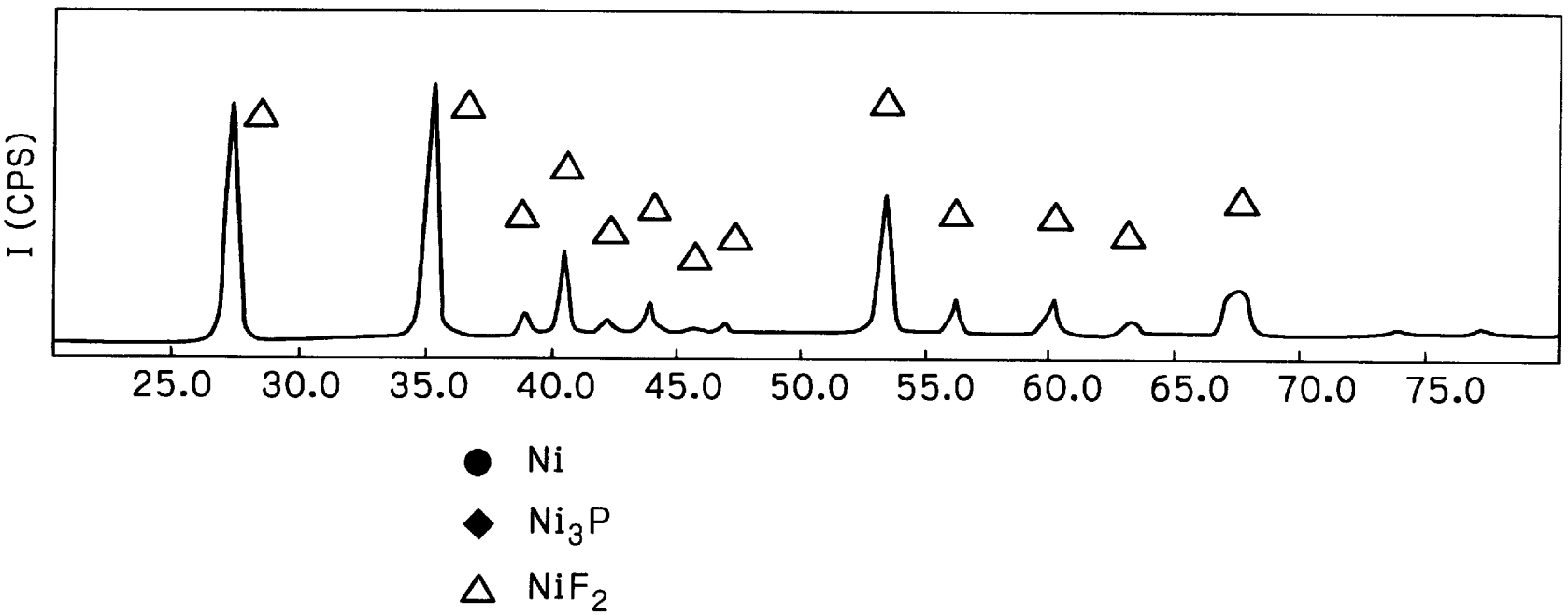
FIG. 6: chart showing the analytical results of Example 4 by the XDF thin-film method.
Figure 7:
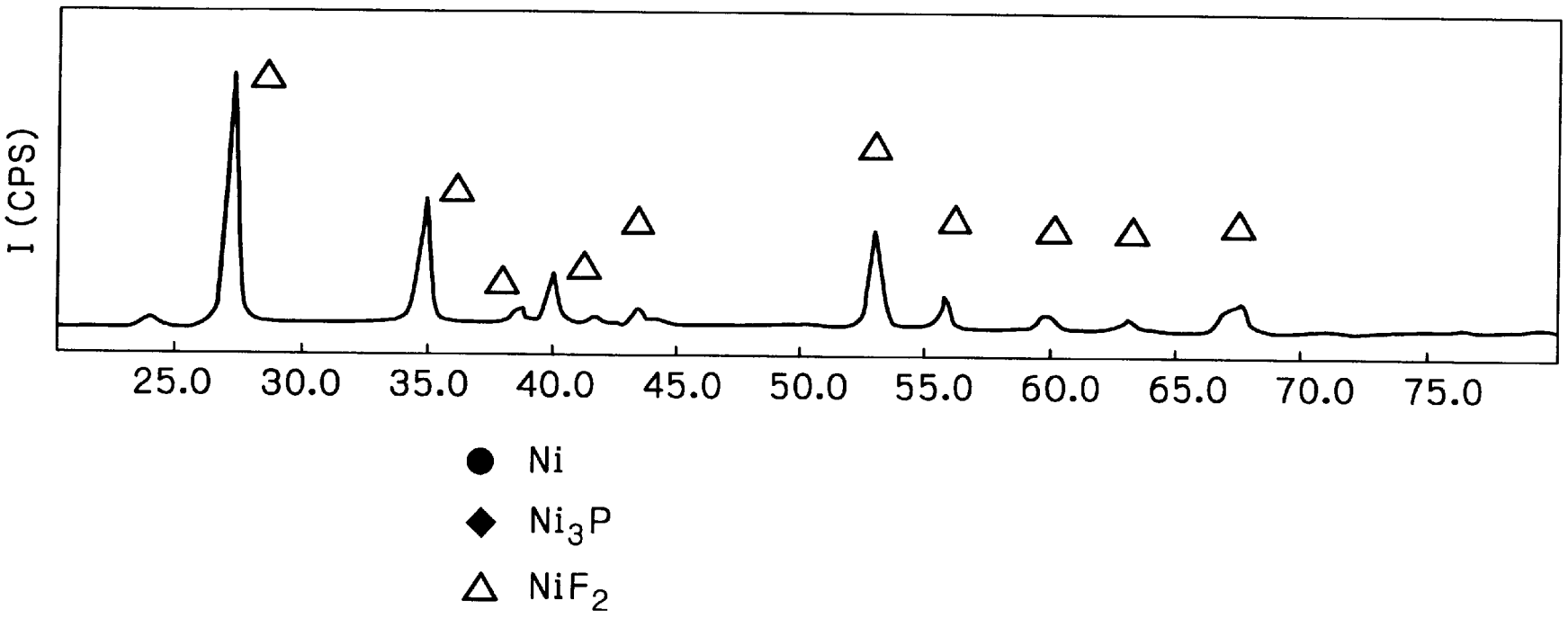
FIG. 7: chart showing the analytical results of Example 6 by the XDF thin-film method.

The results of the fluorinated Production Examples 2, 4 and 6, are shown in FIGS. 5, 6 and 7. It is confirmed from FIG. 5 that nickel fluoride ($NiF_2$) was formed on the surface of the nickel metal.

From FIG. 6, diffraction peaks of Ni or $Ni_3P$ appear very slightly, and the predominant peaks and most of the other peaks are $NiF_2$. These peaks are detected at high intensity. The measurement by a thin-film method was carried out at an incident angle (θ) 1° of X-ray. Theoretically, the analyzed thickness corresponds to 2.1 $\mu$m from the surface. The fluoride film is, therefore, in the order of om thickness on the surface of the electroless nickel plating.

From FIG. 7, diffraction peaks of Ni or $Ni_3P$ are very slightly detected, and predominant peaks and most of the other peaks are $NiF_2$, as well. These peaks are detected at high intensity. This result is almost the same as that of Example 6. There is no great difference in the surface state from Example 6.

Figure 8:
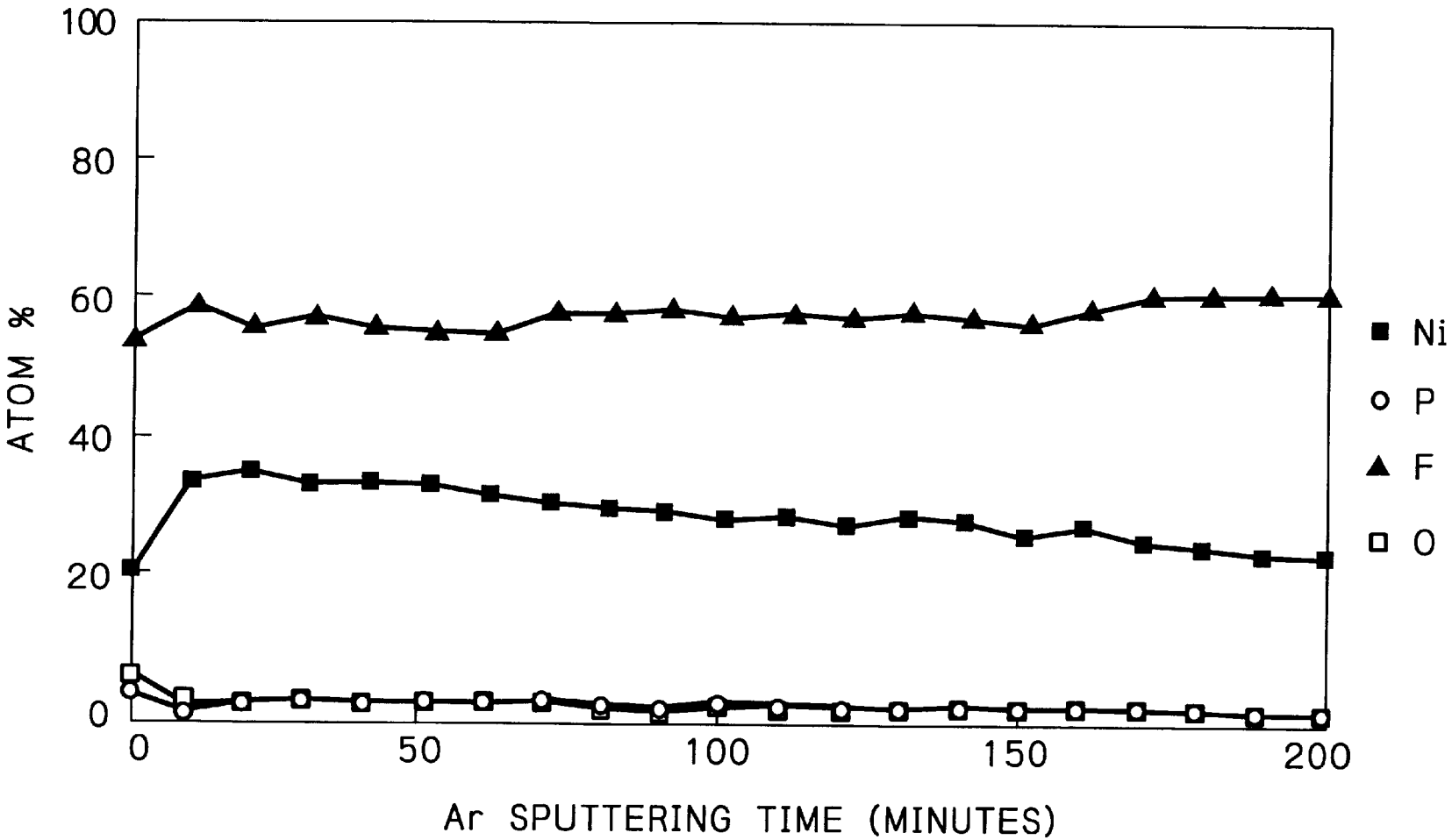
FIG. 8: chart showing the analytical results of the surface composition of Example 3 by the AES.

In FIG. 8 is shown the analysis results of the specimen according to Example 3 by AES (Auger Electron Spectroscopy). Four elements, i.e., Ni. F, O and C, were detected on the surface. The element composition on the top surface layer is shown in Table 1. C and O, which would have resulted from the moisture and contaminants on the surface, were removed by argon-ion sputtering for a few minutes, and were not further detected. The atomic proportion of Ni and F is approximately 1:2. It could be confirmed from this result with the above-described results of X-ray diffraction, that the nickel fluoride ($NiF_2$) was formed on the top surface layer. When the argon-ion sputtering was further carried out until the fluorine became non-detectable, the detection intensity of fluorine started to decrease from after approximately 90 minutes, and then became almost non-detectable after approximately 150 minutes. From this, and also from the etching rate of 115 angstroms/minute ($SiO_2$ correction) by the argon-ion sputtering, the thickness of the fluorinated layer including the fluorine diffusion layer was judged to be 1.7 μm. It could thus be confirmed that the thickness of the fluorinated layer is in the order of μm.

TABLE 1

Surface Composition of Example 3 according to AES

| Detected Elements | Surface Composition (wt %) |
|---|---|
| P | Not detected |
| C | 3.3 |
| O | 12.1 |
| F | 48.9 |
| Ni | 35.7 |

Figure 9:
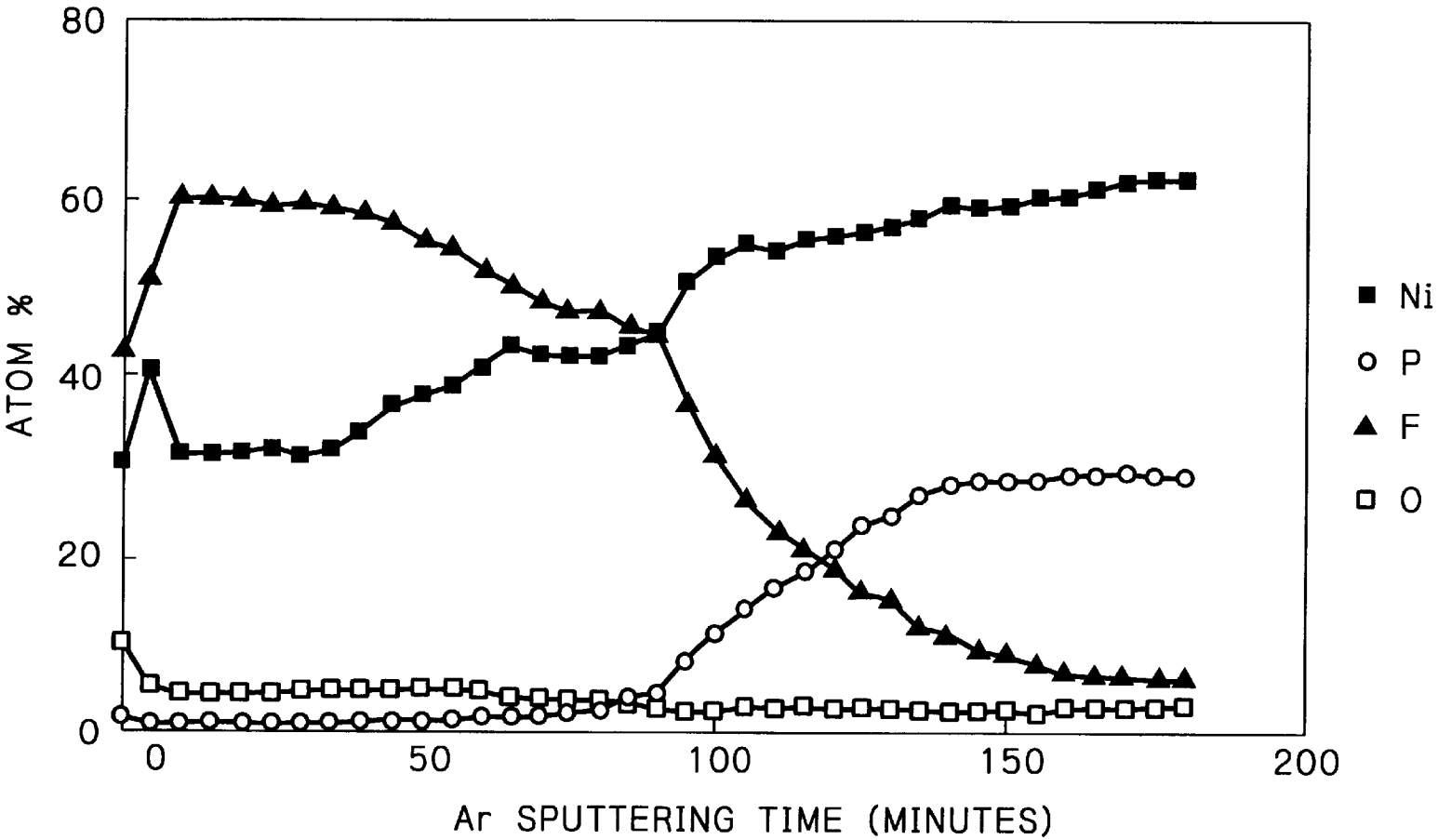
FIG. 9: chart showing the analytical results of the thickness of fluorination of Example 4 film by the AES.

In FIG. 9 are shown the AES analytical results of specimens of Example 4. Four elements, i.e., Ni, F, O and C, were detected on the surface, as in the above-described Example 3. The element composition on the top surface is shown in Table 2. C and O, which would have resulted from the moisture and contaminants on the surface, were removed by argon-ion sputtering for a few minutes and then were not further detected. The atomic proportion of Ni and F is approximately 1:2. It could be confirmed from this result together with the above-described results of X-ray diffraction, that nickel fluoride ($NiF_2$) was formed on the top surface layer. When the argon-ion sputtering was further carried out for 280 minutes, there occurred no great change in the surface state. From this, and also from the etching rate by the argon-ion sputtering, the thickness ($SiO_2$) was judged to be 3.2 μm or more. It could thus be confirmed that the thickness of the fluorinated layer is in the order of μm.

TABLE 2

Surface Composition of Example 3 according to AES

| Detected Elements | Surface Composition (wt %) |
|---|---|
| P | Not detected |
| C | 17.4 |
| O | 4.3 |
| F | 55.1 |
| Ni | 23.3 |

Figure 10:
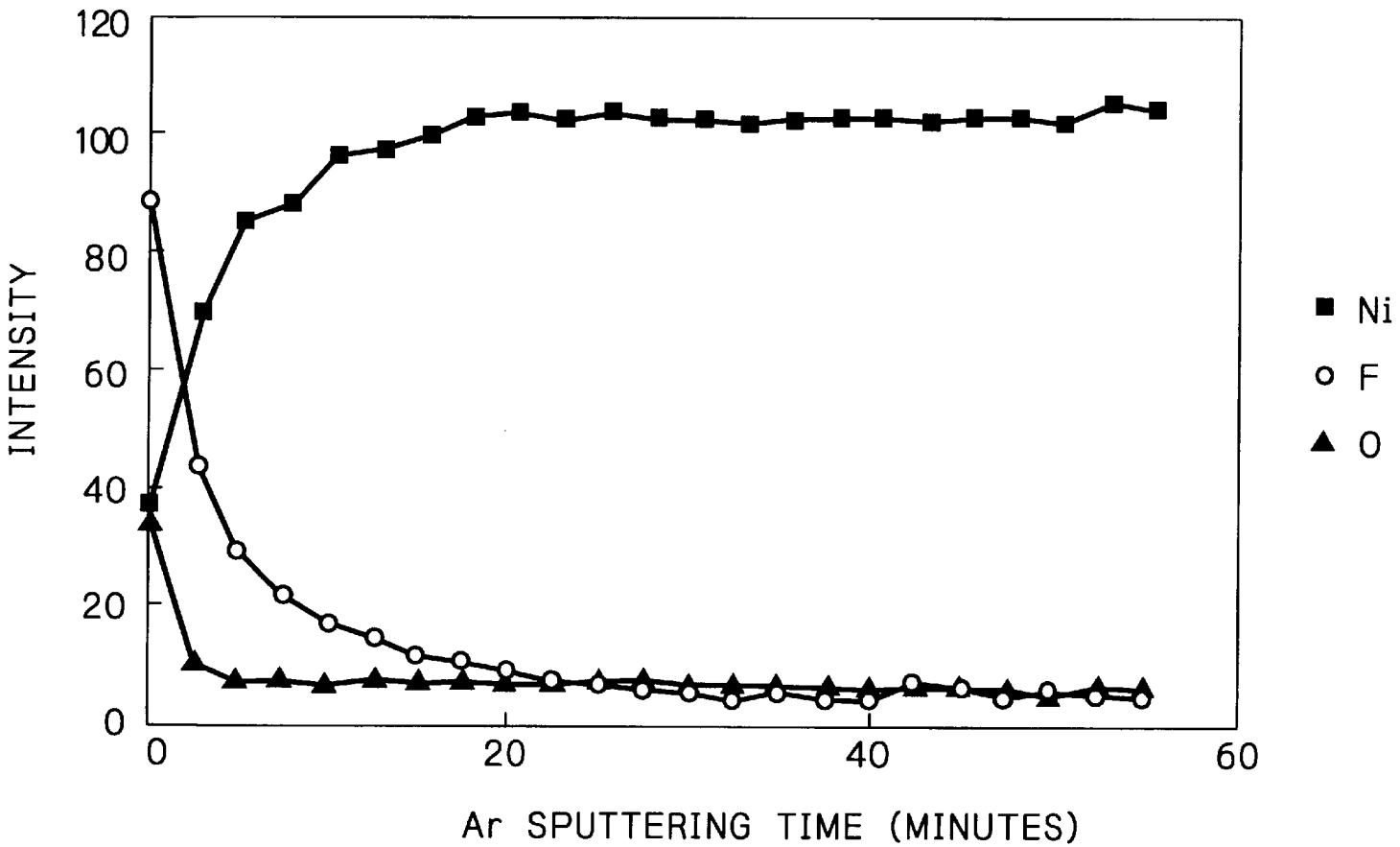
FIG. 10: chart showing the analytical results of the specimens of Comparative Example 1 according to AES.

In FIG. 10 are shown the AES analytical results of specimens of Comparative Example 1. Four elements, i.e., Ni, F, O and C, were detected on the surface. The element composition on the top surface is shown in Table 3. C and O, which would have resulted from the moisture and contaminants on the surface, were removed by argon-ion sputtering for approximately one minute, and then were not further detected. The atomic proportion of Ni and F is approximately 1:2. However, the detection intensity of fluorine decreased after a few minutes from the beginning of sputtering, and the fluorine was not detected at approximately 20 minutes. From this, and also from the etching rate by the argon-ion sputtering amounting to 115 angstroms/minute ($SiO_2$ correction), the thickness was judged to be 2300 angstroms. It could thus be confirmed that the thickness of the fluorinated film is in the order of sub μm.

TABLE 3

Surface Composition of Comparative Example 1 according to AES

| Detected Elements | Surface Composition (wt %) |
|---|---|
| P | Not detected |
| C | 3.6 |
| O | 14.9 |
| F | 57.7 |
| Ni | 23.7 |

Effect Example 1

Corrosion-resistance test of various materials was carried out. The results are shown in Table 4. The evaluation of the corrosion resistance test was expressed by the weight loss of the various materials which were immersed in the 35% hydrochloric-acid aqueous solution at room temperature (25° C.) for 24 hours. The surface-treated specimens formed in Production Examples 2 and 3 as the comparative materials and the specimens of Examples 3, 4, 5 and 6 were used. The weight loss was measured upon withdrawal after 24 hours. As a result of comparison, it turned out that weight loss of Example 5 was the smallest.

Regarding change in appearance, pitting corrosion occurred on the edges and the other portions of the samples of Examples 3 and 5. Apart from this point, the corrosion-weight loss of each Example was smaller than that of the electroless nickel plating of Production Examples 3 and 5. It was revealed from this fact that the specimens, on which surface the fluoride is formed, exhibit greatly improved corrosion resistance.

TABLE 4

Test Result of Resistance Against Hydrochloric Acid

| No. | Name of Samples | Weight Loss ($mg/dm^2$) |
|---|---|---|
| 01 | Production Example 2 | 15.1 |
| 02 | Production Example 3 | 26.3 |
| 03 | Example 3 | 1.2 |
| 04 | Example 4 | 14.1 |
| 05 | Example 5 | 2.1 |
| 06 | Example 6 | 14.3 |

Testing Condition- 35% hydrochloric acid, 25° C., immersion for 12 hours

Effect Example 2

Figure 11:
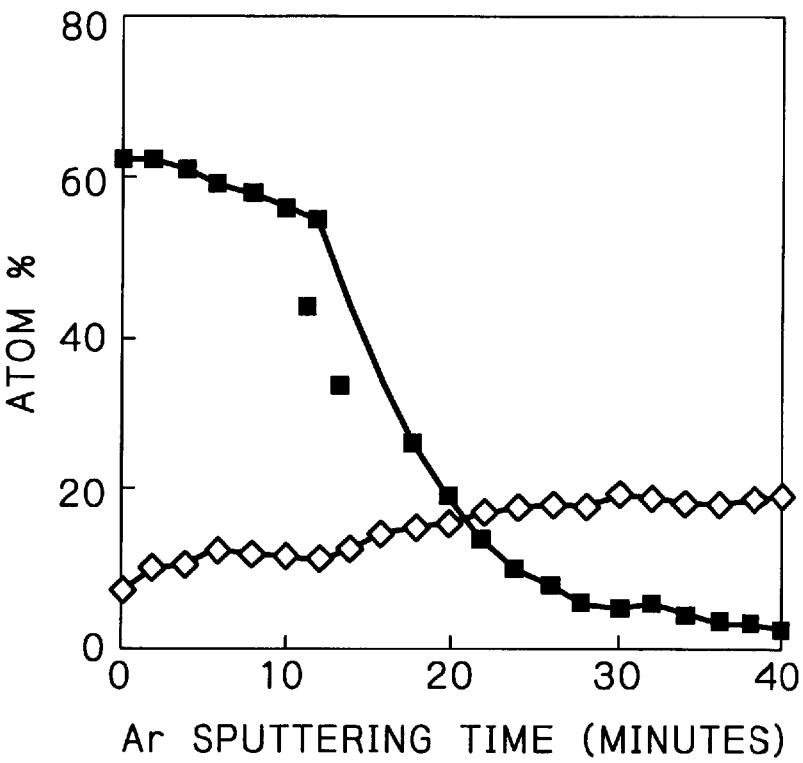
FIG. 11: graph showing the measurement results of the natural oxide film and gas-phase oxidation film on the Al alloy material, by AES.
Figure 11:
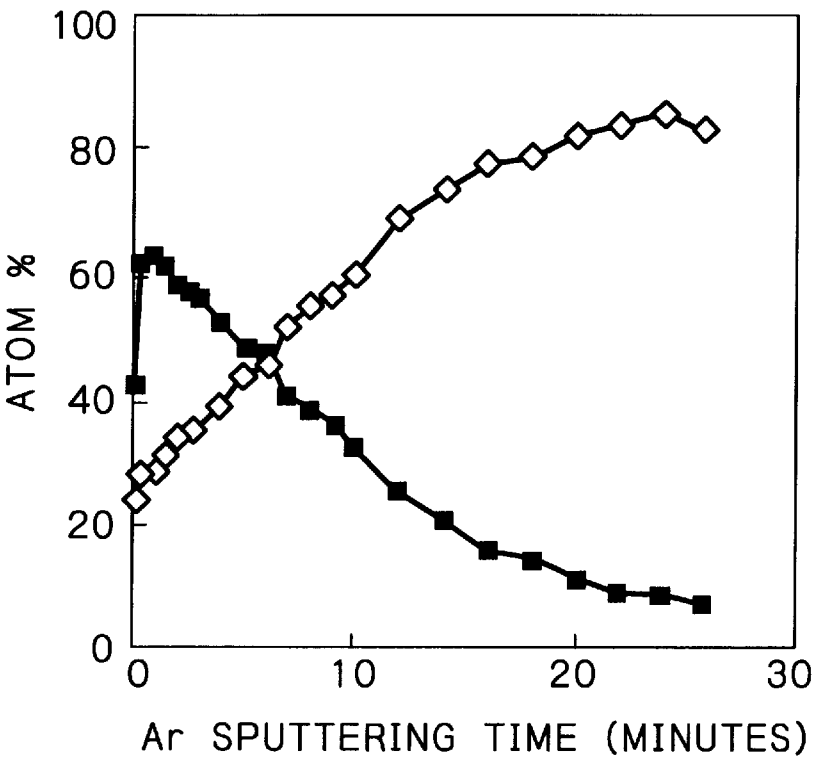

The corrosion-resistance test of the specimens of Example 3 was carried out. The results are shown in FIG. 11 (Table 5). A solution or reagents such as 20% nitric acid, 50% hydrofluoric acid, 20% sulfuric acid, 20% phosphoric acid, 28% ammonia water, 28% caustic soda, 50% formic acid, 20% acetic acid, oxalic acid, organic solvent (acetone), ethanol, EDTA, tetramine and hydrochloric acid hydroxylamine were prepared. Various materials were immersed in the solutions or reagents at room temperature (30° C.) for 24 hours. The evaluation of corrosion resistance was expressed by the weight loss during the immersion. In every testing liquid, the specimens of Example 3 exhibited improved corrosion resistance from the viewpoint of weight loss and observation of appearance as compared with the electroless nickel plated and un-fluorinated specimens according to Example 3.

TABLE 5

Results of Corrosion Resistance

| Test No | Reagents | Weight Loss ($mg/dm^2$) Production Example 2 | Example 3 |
|---|---|---|---|
| 01 | Nitric acid (20%) | 1795 | 646 |
| 02 | Hydrofluoric acid (50%) | 22.5 | 1.1*1 |
| 03 | Sulfuric acid (20%) | 133 | 106 |
| 04 | Phosphoric acid (20%) | 66.2 | 4.6 |
| 05 | Ammonia water (28%) | 222 | 32.8 |
| 06 | Caustic soda (1N) | 4.0 | 2.4 |
| 07 | Formic acid (50%) | 43.1 | 1.5 |
| 08 | Acetic acid (20%) | 104 | 1.2 |
| 09 | Oxalic acid | 2.4 | 0.6 |
| 10 | Acetone | 0.0 | 0.0 |
| 11 | Ethanol | 0.0 | 0.9 |
| 12 | EDTA | 18.9 | 7.3*2 |
| 13 | Tetramine | 0.0 | 1.8*2 |
| 14 | Hydrochloric acid hydroxylamine | 770 | 22.2*2 |

Test conditions: various reagents at 25° C. The weight loss was calculated after immersion for 24 hours.
Remarks *1Immersion for 100 hours
Remarks *2Immersion for 300 hours Wear-resistance of the specimens of Production Example 2 and Examples 3, 4 was tested using a scratch tester. The results are shown in Table 6. Although there was no great difference in the static friction-coefficient between Production Example 2 and each of Examples 3 and 4, the dynamic friction coefficient of fluorinated Examples 3 and 4 was approximately a half of that of Production Example 2. The fluorinated Examples 3 and 4 exhibit, therefore, improved sliding performance.

TABLE 6

Measurement Result of Wear Resistance Scratch Test

| No | Name of Samples | Static Coefficient of Friction | Dynamic Coefficient of Friction | Wear Resistance (Remarks) |
|---|---|---|---|---|
| 01 | Production Example 2 | 0.143 | 0.354 | one time |
| 03 | Production Example 3 | 0.123 | 0.158 | 30 times |
| 04 | Production Example 4 | 0.120 | 0.178 | 208 times |

(Remarks) Wear resistance. A pin was continuously caused to slide on a specimen at a constant load (300 g) using a scratch tester until the film was broken. Time until the breaking is indicated.

The wear-resistance test was carried out under a constant load. As a result of the test, the sliding friction performance and film durability in terms of the sliding time until the film breaks only one time in Production Example 2, while it is 30 times in Example 3 and 208 times in Example 4. Particularly, since in Example 4, in which the fluoride film which is thick in the order of $\mu$m exhibited wear-resistance and durability better than those of the electroless nickel-plating, it was clarified that the durability of Example 4 is of a level satisfactory for practical use.

Reference Example 1

Figure 12:
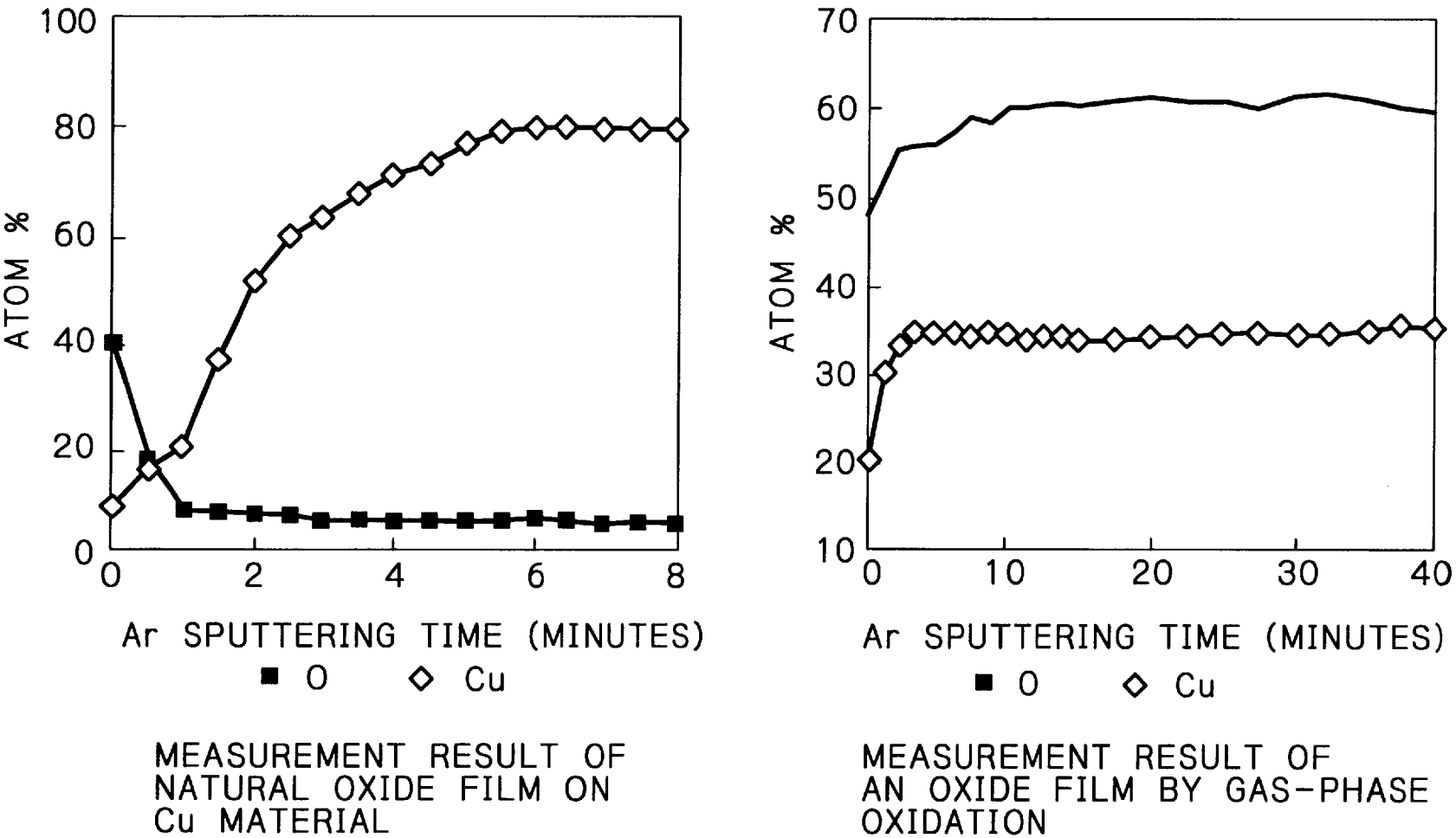
FIG. 12: graph showing the measurement results of the natural oxide film and gas-phase oxidation film on the Cu metal.

Differences between the natural oxide film and the gas-phase oxide film formed by the forced oxidation on the aluminum alloy were analyzed by AES. The analytical results are shown in FIG. 12. The thickness of natural oxide film formed on the samples of Production Example 4 was judged to be slightly more than approximately 550 angstroms. This judgement was made from slightly more than approximately five minutes of the half time, in which the O-detecting intensity decreased to a half, and also from 115 angstroms of the etching rate ($SiO_2$ correction). Contrary to this, it is clear the oxidation film of the samples, which were forcibly oxidized under the gas phase in Example 7, amounts to 2500 angstroms in terms of the same judgement.

Comparative Example 2

Figure 13:
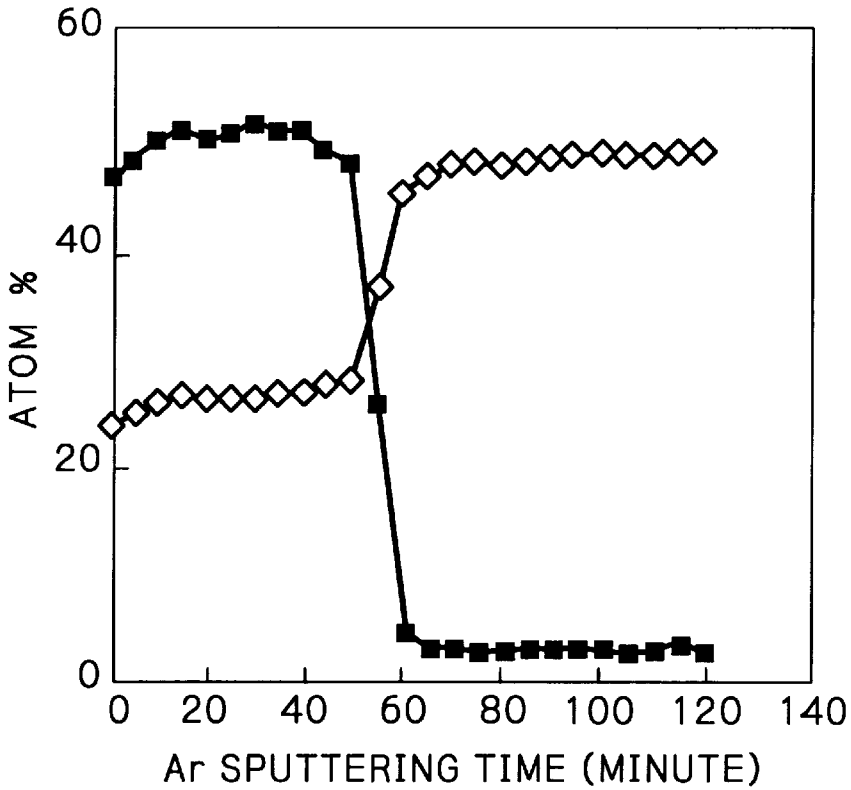
FIG. 13: graph showing the measurement results of the gas-phase oxidation film and liquid-phase oxidation film on NiP film by AES.
Figure 13:
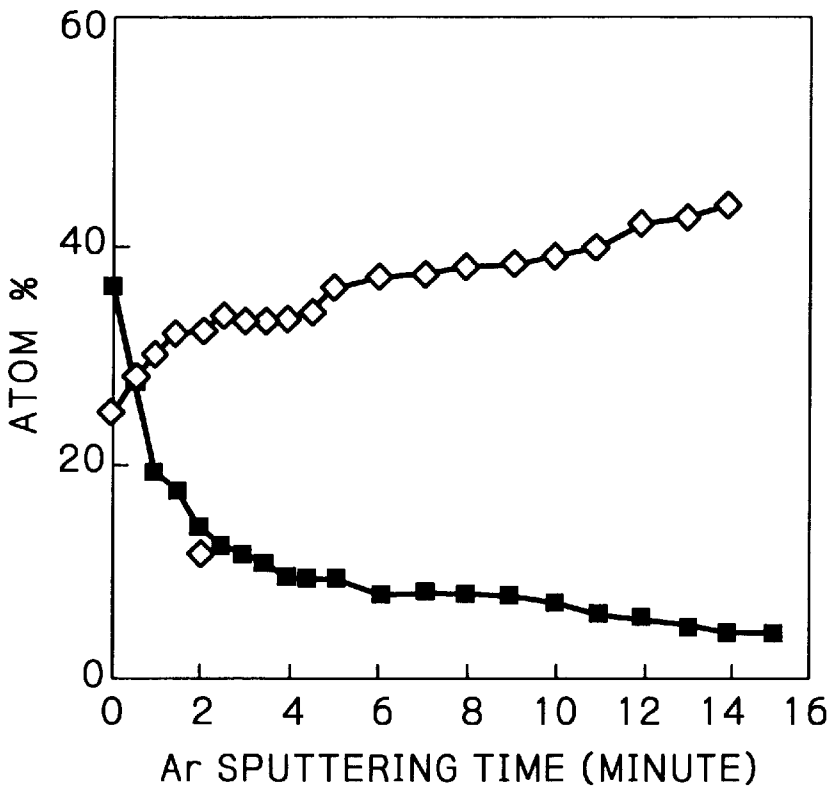

Differences between the natural oxide film and the gas-phase oxide film formed by the forced oxidation on the copper alloy was analyzed by AES. The analytical results are shown in FIG. 13. The thickness of natural oxide film formed on the samples of Production Example 5 was judged to be approximately 40 angstroms. This judgement is made from approximately 20 seconds of the half-time, in which the O-detecting intensity decreased to a half and also from 115 angstroms of the etching rate ($SiO_2$ correction). Contrary to this, it is clear the oxidation film of the samples, which were forcibly oxidized under the gas phase in Example 8, amounts to 1 $\mu$m or more, since the oxide film was not removed by the argon-ion sputtering for 80 minutes.

Comparative Example 3

Differences between the liquid-phase oxidation film and the gas-phase oxidation film was analyzed by AES. The analytical results are shown in FIG. 14. The thickness of the liquid-phase oxidation film formed on the samples of Example 9 was judged to be 200 angstroms. This judgement was made after approximately 100 seconds of the half-time, in which the O-detecting intensity was decreased to a half, and also from 115 angstroms/minute of the etching rate ($SiO_2$ correction).

Meanwhile, the specimens of Example 3 were forcibly oxidized by the oxygen gas. At this stage, the specimens were withdrawn from the reaction furnace. It is clear that the oxidation film of such specimens amounts to approximately 0.6 $\mu$m contrary to Example 9, since the oxide film is removed by the argon-ion sputtering of approximately 55 minutes.

The thick fluorinated layer attained by the present invention has improved resistance against acid and alkali, and is therefore extremely useful for the plant members of the semiconductor-related machinery and devices among others. The metallic material or film, on which the surfacial fluorinated layer is formed, is, therefore, extremely useful for the production apparatuses of semiconductor devices, and plant members of vacuum-related machineries and devices.

What is claimed is:

1. A fluorinated aluminum article having a fluorinated layer formed by forcibly oxidizing a surface of a monolithic aluminum and thereafter fluorinating the forcibly oxidized surface and having 1 $\mu$m or more of fluorinated layer thickness, wherein said fluorinated layer consists of a first layer, which essentially consists of an aluminum fluoride and a second layer of aluminum which underlies the first layer, and into which fluorine is diffused.

2. A fluorinated aluminum article according to claim 1, wherein said first layer has a thickness of from approximately 1000 angstroms or more.

3. A fluorinated aluminum article according to claim 2, wherein said first layer has a thickness of 100 $\mu$m or less.

4. A fluorinated metal article, having a fluorinated layer formed by forcibly oxidizing a surface of a monolithic metal which is at least one metal selected from the group consisting of nickel, copper and silver, and thereafter fluorinating the forcibly oxidized surface and having 1 μm or more of fluorinated layer thickness.

5. A fluorinated metal article according to claim 4, wherein said fluorinated layer consists of a first layer, which essentially consists of a fluoride of said metal, and a second layer of said metal, which underlies the first layer, and into which fluorine is diffused.

6. A fluorinated metal article according to claim 5, wherein said first layer has a thickness of from approximately 1000 angstroms or more.

7. A fluorinated metal article according to claim 6, wherein said first layer has a thickness of 100 μm or less.

8. A fluorinated aluminum article having a fluorinated layer formed by forcibly oxidizing a surface of an aluminum film formed on a monolithic material and thereafter fluorinating the forcibly oxidized surface and having 1 μm or more of fluorinated layer thickness, wherein said fluorinated layer consists of a first layer, which essentially consists of an aluminum fluoride, and a second layer of said aluminum which underlies the first layer, and into which fluorine is diffused.

9. A fluorinated aluminum article according to claim 8, wherein said first layer has a thickness of from approximately 1000 angstroms or more.

10. A fluorinated aluminum article according 9, wherein said first layer has a thickness of 100 μm or less.

11. A fluorinated aluminum article according to claim 10, wherein said aluminum film consists of one film selected from the group consisting of electrolytic plating film, electroless plating film and physical vapor deposition film.

12. A fluorinated aluminum article according to claim 8, 9, 10 or 11, wherein the fluorination is carried out by using a fluorination gas, which is at least one gas selected from the group consisting of fluorine ($F_2$), chlorine trifluoride ($ClF_3$) and nitrogen fluoride ($NF_3$), or this gas diluted by inert gas.

13. A fluorinated aluminum article according to claim 12, wherein fluorination gas is brought into contact with said forcibly oxidized layer at a temperature of from 150 to 700° C. for a time period of 3 to 48 hours.

14. A fluorinated aluminum article according to claim 13, wherein the contact time is at least 24 hours.

15. A fluorinated metal article having a fluorinated layer formed by forcibly oxidizing a surface of a metal film which is at least one metal selected from the group consisting of nickel, copper and silver, formed on a monolithic material and thereafter fluorinating the forcibly oxidized surface and having 1 μm or more of fluorinated layer thickness.

16. A fluorinated metal article according to claim 15, wherein said fluorinated layer consists of a first layer, which essentially consists of a fluoride of said metal, and a second layer of said metal which underlies the first layer, and into which fluorine is diffused.

17. A fluorinated metal article according to claim 16, wherein said first layer has a thickness of from approximately 1000 angstroms or more.

18. A fluorinated metal article according to claim 17, wherein said first layer has a thickness of 100 μm or less.

19. A fluorinated metal article according to claim 15, wherein said metal film consists of one film selected from the group consisting of electrolytic plating film, electroless plating film and physical vapor deposition film.

20. A fluorinated metal article according to claim 19, wherein said metal film is a nickel film.

21. A fluorinated metal article according to claim 20, wherein said metal film is an electroless plated nickel film.

22. A fluorinated metal article according to claim 19, 20 or 21, wherein the fluorination is carried out by using a fluorination gas, which is at least one gas selected from the group consisting of fluorine ($F_2$), chlorine trifluoride ($ClF_3$) and nitrogen fluoride ($NF_3$), or this gas diluted by inert gas.

23. A fluorinated metal article according to claim 22, wherein fluorination gas is brought into contact with said forcibly oxidized layer at a temperature of from 150 to 700° C. for a time period of 3 to 48 hours.

24. A fluorinated metal article according to claim 23, wherein the contact time is least 24 hours.

25. A fluorination process of aluminum, comprising the steps of: forcibly oxidizing a surface of a monolithic aluminum by an oxidizing material; and, bringing said a resulting forcibly oxidized layer into contact with a fluorination gas to form a fluorinated layer having 1 μm or more of thickness, wherein said fluorinated layer consists of a first layer, which essentially consists of an aluminum fluoride and a second layer of aluminum, which underlies the first layer, and into which fluorine is diffused.

26. A fluorination process according to claim 25, wherein said oxidizing material is at least one gas selected from the group consisting of oxygen, nitrogen peroxide, ozone and a mixed gas containing these gases.

27. A fluorination process according to claim 25, wherein said oxidizing material is nitric acid or an aqueous solution of hydrogen peroxide.

28. A fluorination process according to claim 25, wherein said oxidizing material is oxygen generated on an anode of an anodic oxidation method.

29. A fluorination process according to claim 25, 26, 27 or 28, wherein said fluorination gas is at least one gas selected from group consisting of fluorine ($F_2$), chlorine trifluoride ($ClF_3$) and nitrogen fluoride ($NF_3$), or this gas diluted by inert gas.

30. A fluorination process according to claim 29, wherein the contact of the fluorination gas is carried out at a temperature of from 150 to 500° C. for a time period of 3 to 48 hours.

31. A fluorination process according to claim 30, wherein the contact time is at least 24 hours.

32. A fluorination process of aluminum comprising the steps of: forming an aluminum film on a monolithic material; forcibly oxidizing a surface of said aluminum film by an oxidizing material; and, bringing a resulting forcibly oxidized layer into contact with a fluorination gas to form a fluorinated layer having 1 μm or more of thickness, wherein said fluorinated layer consists of a first layer, which essentially consists of an aluminum fluoride and a second layer of aluminum, which underlies the first layer, and into which fluorine is diffused.

33. A fluorination process according to claim 32, wherein said aluminum film is formed by one method selected from the group consisting of electrolytic plating, electroless plating and physical vapor deposition.

34. A fluorination process according to claim 32 or 33, wherein said oxidizing material is at least one gas selected from the group consisting of oxygen, nitrous oxide, nitrogen peroxide, ozone and a mixed gas containing these gases.

35. A fluorination process according to claims 32 or 33, wherein said oxidizing material is nitric acid or an aqueous solution of hydrogen peroxide.

36. A fluorination process according to claim 32 or 33 wherein said oxidizing material is oxygen generated on an anode of an anodic oxidation method.

37. A fluorination process according to claim 32, wherein said fluorination gas is at least one gas selected from the group consisting of fluorine ($F_2$), chlorine trifluoride ($ClF_3$) and nitrogen fluoride ($NF_3$), or this gas diluted by inert gas.

38. A fluorination process according to claim 37, wherein the contact of the fluorination gas is carried out at a temperature of from 150 to 700° C. for a time period of 3 to 48 hours.

39. A fluorination process according to claim 37, wherein the contact time is at least 24 hours.

40. A fluorination process of metal, comprising the steps of: forcibly oxidizing a surface of a monolithic metal which is at least one metal selected from the group consisting of nickel, copper and silver, by an oxidizing material; and, bringing a resulting forcibly oxidized layer into contact with a fluorination gas to form a fluorinated layer having 1 $\mu$m or more of thickness.

41. A fluorination process according to claim 40, wherein said oxidizing material is at least one gas selected from the group consisting of oxygen, nitrous oxide, nitrogen peroxide, ozone and a mixed gas containing these gases.

42. A fluorination process according to claim 40, wherein said oxidizing material is nitric acid or an aqueous solution of hydrogen peroxide.

43. A fluorination process according to claim 40, wherein said oxidizing material is oxygen generated on an anode of an anodic oxidation method.

44. A fluorination process according to claim 40, 41, 42 or 43, wherein said fluorination gas is at least one gas selected from the group consisting of fluorine ($F_2$), chlorine trifluoride ($ClF_3$) and nitrogen fluoride (NF3), or this gas diluted by inert gas.

45. A fluorination process according to claim 44, wherein the contact of the fluorination gas is carried out at a temperature of from 150 to 500° C. for a time period of 3 to 48 hours.

46. A fluorination process according to claim 44, wherein the contact time is at least 24 hours.

47. A fluorination process of metal, comprising the steps of: forming a metal film on a monolithic material, said metal is at least one selected from the group consisting of nickel, copper and silver; forcibly oxidizing a surface of said metal film by an oxidizing material; and, bringing a resulting forcibly oxidized layer into contact with a fluorination gas to form a fluorinated layer having 1 $\mu$m or more of thickness.

48. A fluorination process according to claim 47, wherein said metal film is formed by one method selected from the group consisting of electrolytic plating, electroless plating and physical vapor deposition.

49. A fluorination process according to claim 47 or 48, wherein said oxidizing material is at least one gas selected from the group consisting of oxygen, nitrous oxide, nitrogen peroxide, ozone and a mixed gas containing these gases.

50. A fluorination process according to claims 47 or 48, wherein said oxidizing material is nitric acid or an aqueous solution of hydrogen peroxide.

51. A fluorination process according to claims 47 or 48 wherein said oxidizing material is oxygen generated on an anode of an anodic oxidation method.

52. A fluorination process according to claim 47, wherein said fluorination gas is at least one gas selected from the group consisting of fluorine ($F_2$), chlorine trifluoride ($ClF_3$) and nitrogen fluoride ($NF_3$), or this gas diluted by inert gas.

53. A fluorination process according to claim 52, wherein the contact of the fluorination gas is carried out at a temperature of from 150 to 700° C. for a time period of 3 to 48 hours.

54. A fluorination process according to claim 52, wherein the contact time is at least 24 hours.

55. A fluorination process according to claim 52, wherein said metal film is a nickel film.

56. A fluorination process according to claim 55, wherein said metal film is an electroless plated nickel film.

57. A fluorination process according to claim 52, 55 or 56, wherein said oxidizing material is at least one gas selected from the group consisting of oxygen, nitrous oxide, nitrogen peroxide, ozone and a mixed gas containing these gases.

58. A fluorination process according to claim 52, 55 or 56, wherein said oxidizing material is nitric acid or an aqueous solution of hydrogen peroxide.

59. A fluorination process according to claim 53, 55 or 56, wherein said oxidizing material is oxygen generated on an anode of an anodic oxidation method.

60. A fluorination process according to claim 59, wherein the contact of the fluorination gas is carried out at a temperature of from 150 to 700° C. for a time period of 3 to 48 hours.

61. A fluorination process according to claim 60, wherein the contact time is at least 24 hours.

* * * * *